US005860751A

United States Patent [19]

Ogasawara

[11] Patent Number: 5,860,751

[45] Date of Patent: Jan. 19, 1999

[54] THERMAL TRANSFER PRINTER

[75] Inventor: Masashi Ogasawara, Iwate-ken, Japan

[73] Assignee: Alps Electric Co., Ltd., Tokyo, Japan

[21] Appl. No.: 870,439

[22] Filed: Jun. 6, 1997

[30] Foreign Application Priority Data

Jun. 14, 1996 [JP] Japan ..... 8-154079

[51] Int. Cl.[6] ..... B41J 2/315; B41J 33/16

[52] U.S. Cl. ..... 400/206; 400/120.01; 347/193; 347/188

[58] Field of Search ..... 400/206, 120.9; 347/198, 171, 188, 193

[56] References Cited

U.S. PATENT DOCUMENTS

| | | | |
|---|---|---|---|
| 5,157,413 | 10/1992 | Nagato et al. | 400/232 |
| 5,467,120 | 11/1995 | Sadaki et al. | 347/171 |
| 5,631,688 | 5/1997 | Hibino et al. | 347/171 |

FOREIGN PATENT DOCUMENTS

| | | | |
|---|---|---|---|
| 63-296966 | 12/1988 | Japan . | |
| 2-208058 | 8/1990 | Japan | 347/198 |
| 4-303663 | 10/1992 | Japan . | |
| 5-185620 | 7/1993 | Japan . | |
| 07125363 | 5/1995 | Japan . | |

*Primary Examiner*—Edgar Burr
*Assistant Examiner*—Daniel J. Colilla
*Attorney, Agent, or Firm*—Brinks Hofer Gilson & Lione

[57] ABSTRACT

Provided is a thermal transfer printer which can stably perform recording using an ink ribbon formed of a base member coated with heat-fusible ink and recording using an ink ribbon formed of a base member coated with heat-sublimated ink without needing any complicated mechanism. The thermal transfer printer has cassette type detecting means for detecting the type of a ribbon cassette, and control means for controlling rotational speeds of a carriage motor and a ribbon reel-up motor in accordance with a detection result of the cassette type detecting means.

5 Claims, 6 Drawing Sheets

THERMAL TRANSFER PRINTER

BACKGROUND OF THE INVENTION

1. Field of the Invention

The present invention relates to a thermal transfer printer that ink on an ink ribbon is transferred to a sheet of paper for recording through selective heating of heat generating elements of a thermal head, and more particularly to a thermal transfer printer capable of selectively performing recording with thermal fusion transfer and recording with thermal sublimation transfer at operator's option.

2. Description of the Related Art

A thermal transfer printer generally records images, such as desired characters, on a sheet of paper as follows. A sheet of paper is supported in front of a platen and a thermal head made up of a plurality of heat generating elements is mounted on a carriage. An ink ribbon as one example of ink films each comprising a base member and desired type of ink coated over the base member is held, along with the sheet of paper, between the thermal head and the platen. While the thermal head is reciprocated along the platen with the carriage, the ink ribbon is reeled out and the heat generating elements of the thermal head are selectively energized to generate heat in accordance with information to be recorded. Such a thermal transfer printer is widely employed as output units of computers, word processors and so on because of high recording quality, low noise, low cost, and easiness in maintenance.

In many of conventional thermal transfer printers, images are recorded on a sheet of paper by using an ink ribbon (heat-fusible ink ribbon) formed of a base member, such as a plastic film, coated with heat-fusible ink. However, there is also known another type of thermal transfer printer that images are recorded on a sheet of paper by using an ink ribbon (heat-sublimated ink ribbon) formed of a base member coated with heat-sublimated ink.

Of those conventional thermal transfer printers, ones recording images on a sheet of paper with heat-fusible ink ribbons (hereinafter referred to as heat-fusion thermal transfer printers) are superior in practical convenience because they can make recording on various types of paper such as plain paper, thick paper and post cards.

On the other hand, thermal transfer printers recording images on a sheet of paper with heat-sublimated ink ribbons (hereinafter referred to as heat-sublimation thermal transfer printers) employ specific paper having been subjected to surface treatment and are able to produce recording images with high quality comparable to silver salt film photography.

Heretofore, heat-fusion thermal transfer printers and heat-sublimation thermal transfer printers have been separately put into practice as different types of thermal transfer printers because of different characteristics of ink used.

But the conventional thermal transfer printers stated above have had problems below due to separation into heat-fusion thermal transfer printers and heat-sublimation thermal transfer printers in commercialization. When it is required to make both types of recording, i.e., general recording on usual paper and high-quality recording on specific paper comparable to silver salt film photography, two units of different thermal transfer printers, i.e., a heat-fusion thermal transfer printer and a heat-sublimation thermal transfer printer, have to be prepared. This needs a large space for installation and increases economic burden.

Accordingly, there has been a demand for a thermal transfer printer which can selectively realize recording using a heat-fusible ink ribbon and recording using a heat-sublimated ink ribbon by one unit.

The applicant has previously proposed a serial thermal transfer printer capable of optionally using a heat-fusible ink ribbon and a heat-sublimated ink ribbon. However, because electric energy to be applied to a thermal head for recording differs largely between the thermal fusion recording and the thermal sublimation recording, the control process requires to be changed depending on a recording mode used. This has resulted in a complicated mechanism to realize recording with good quality in any of the recording modes without damaging ink ribbons.

SUMMARY OF THE INVENTION

An object of the present invention is to provide a thermal transfer printer which can stably perform recording using an ink ribbon formed of a base member coated with heat-fusible ink and recording using an ink ribbon formed of a base member coated with heat-sublimated ink without needing any complicated mechanism.

Another object of the present invention is to reel up an ink ribbon at the optimum timing of separation of ink depending on the type of ink ribbons. To achieve this object, the thermal transfer printer has cassette type detecting means for detecting the type of a ribbon cassette, and control means for controlling rotational speeds of a carriage motor and a ribbon reel-up motor in accordance with a detection result of the cassette type detecting means. Alternatively, the thermal transfer printer has cassette type selecting means for selecting the type of a ribbon cassette, and control means for controlling rotational speeds of a carriage motor and a ribbon reel-up motor in accordance with a detection result of the cassette type selecting means.

Still another object of the present invention is to reliably transfer ink on a heat-sublimated ink ribbon to a recording medium. To achieve this object, the thermal transfer printer has control means for executing control so that when the ribbon cassette detected by the cassette type detecting means is a ribbon cassette housing a heat-sublimated ink ribbon, a ratio of the rotational speed of the ribbon reel-up motor and the rotational speed of the carriage motor has a smaller value than when the detected ribbon cassette is a ribbon cassette housing a heat-fusible ink ribbon. Alternatively, the thermal transfer printer has control means for executing control so that when the ribbon cassette selected by the cassette type selecting means is a ribbon cassette housing a heat-sublimated ink ribbon, a ratio of the rotational speed of the ribbon reel-up motor and the rotational speed of the carriage motor has a smaller value than when the selected ribbon cassette is a ribbon cassette housing a heat-fusible ink ribbon. As an alternative, the thermal transfer printer has control means for executing control so that when the recording mode selected by recording mode selecting means is a second recording mode, a ratio of the rotational speed of the ribbon reel-up motor and the rotational speed of the carriage motor has a smaller value than when the recording mode selected by the recording mode selecting means is a first recording mode. Alternatively, the thermal transfer printer has control means for executing control so that when the recording mode selected by recording mode selecting means is a second recording mode, the rotational speed of the carriage motor is slower than when the recording mode selected by the recording mode selecting means is a first recording mode, and a ratio of the rotational speed of the ribbon reel-up motor and the rotational speed of the carriage motor has a smaller value than when the recording mode selected by the recording mode selecting means is the first recording mode.

Still another object of the present invention is to reel up an ink ribbon at the optimum timing of separation of ink depending on a recording mode. To achieve this object, the thermal transfer printer has recording mode selecting means for selecting a recording mode, and control means for controlling rotational speeds of a carriage motor and a ribbon reel-up motor in accordance with a detection result of the recording mode selecting means.

Still another object of the present invention is to reel up an ink ribbon at the optimum timing of separation of ink depending on the type of recording mediums. To achieve this object, the thermal transfer printer has recording medium detecting means for detecting the type of a recording medium, and control means for controlling rotational speeds of a carriage motor and a ribbon reel-up motor in accordance with a detection result of the recording medium detecting means. Alternatively, the thermal transfer printer has recording medium selecting means for selecting the type of a recording medium, and control means for controlling rotational speeds of a carriage motor and a ribbon reel-up motor in accordance with a selection result of the recording medium selecting means.

Still another object of the present invention is to reliably transfer ink on an ink ribbon to a sheet of OHP paper. To achieve this object, the thermal transfer printer has control means for executing control so that when the recording medium detected by the recording medium detecting means is a sheet of OHP paper, a ratio of the rotational speed of the ribbon reel-up motor and the rotational speed of the carriage motor has a smaller value than when the detected recording medium is a sheet of plain paper. Alternatively, the thermal transfer printer has control means for executing control so that when the recording medium selected by the recording medium selecting means is a sheet of OHP paper, a ratio of the rotational speed of the ribbon reel-up motor and the rotational speed of the carriage motor has a smaller value than when the selected recording medium is a sheet of plain paper.

Still another object of the present invention is to reel up an ink ribbon at the optimum timing of separation of ink depending on a recording speed of a carriage. To achieve this object, the thermal transfer printer has carriage speed selecting means for selecting a recording speed of the carriage, and control means for controlling rotational speeds of a carriage motor and a ribbon reel-up motor in accordance with a detection result of the carriage speed selecting means.

Still another object of the present invention is to reliably transfer ink on an ink ribbon to a recording medium. To achieve this object, the thermal transfer printer has control means for executing control so that when a lower recording speed is selected by the carriage speed selecting means, a ratio of the rotational speed of the ribbon reel-up motor and the rotational speed of the carriage motor has a smaller value than when a higher recording speed is selected.

DETAILED DESCRIPTION OF THE PREFERRED EMBODIMENTS

Figure 1:
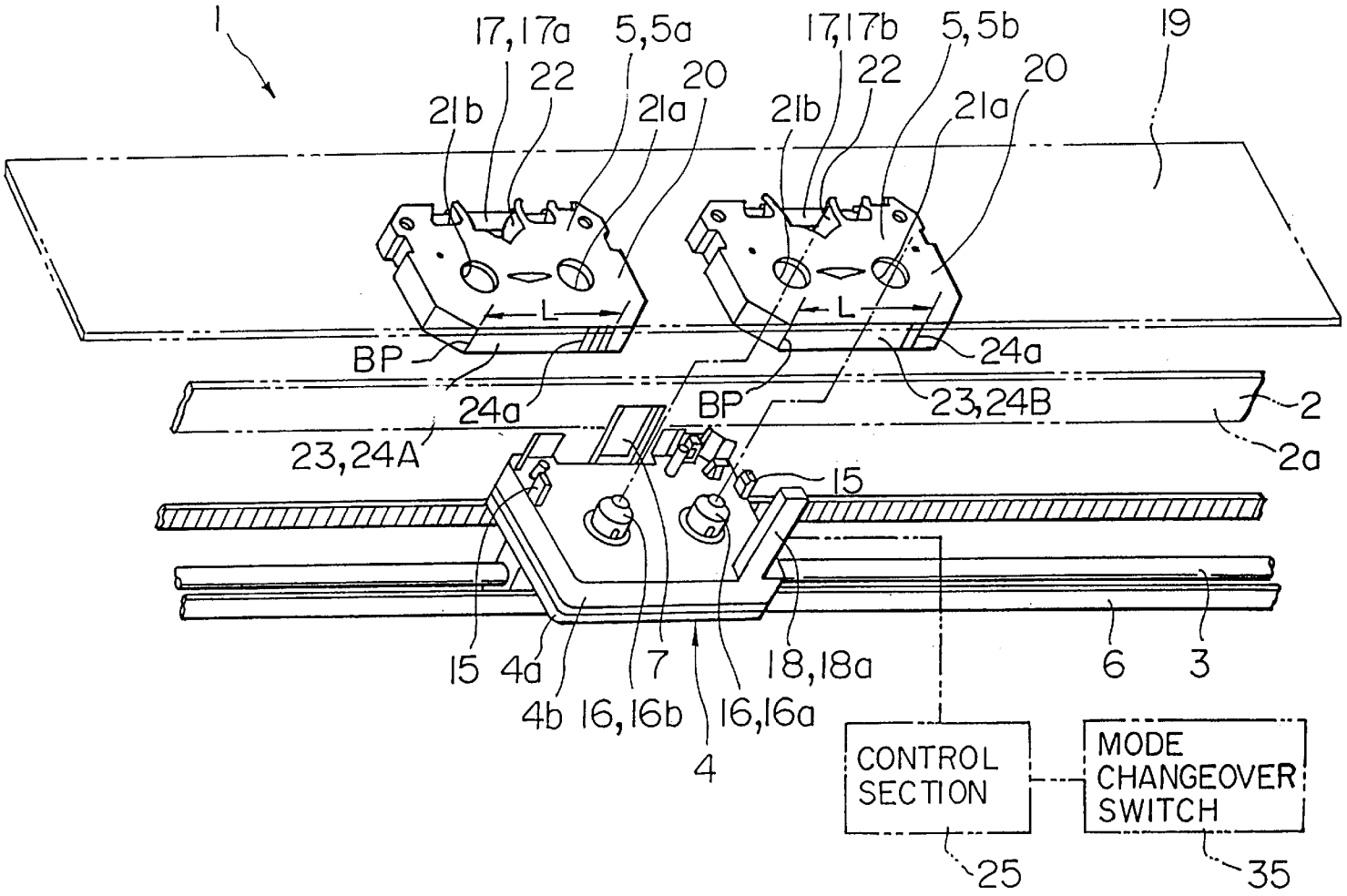
FIG. 1 is a perspective view showing principal parts of one embodiment of a thermal transfer printer according to the present invention.

FIG. 1 illustrates one embodiment of the present invention wherein two types of ink ribbons, i.e., a heat-sublimated ink ribbon and a heat-fusible ink ribbon, can be used selectively. In a thermal transfer printer 1 of this embodiment shown in FIG. 1, a platen 2 in the form of a flat plate is disposed on a frame (not shown) in a desired position with its recording surface 2*a* lying substantially vertically, and a guide shaft 3 is disposed parallel to the platen 2 forwardly and downwardly of the platen 2. A carriage 4 vertically divided into two parts is mounted on the guide shaft 3 in an appropriate position. One carriage 4*a* shown on the lower side in the drawing serves as a lower carriage mounted on the guide shaft 3, and the other carriage 4*b* shown on the upper side in the drawing serves as an upper carriage into which a ribbon cassette 5 described later is loaded and which is vertically movable toward and away from the lower carriage 4*a*.

The carriage 4 is driven to reciprocate along the guide shaft 3 with a suitable driving belt 6 which extends to run around a pair of pulleys (not shown) and is driven by a carriage motor 26*a* (FIG. 4) such as a stepping motor 26 described later. Also, the carriage 4 can be moved selectively at one of speeds changeable in two stages, i.e., a high speed and a low speed, by a controller 25 (described later) controlling a rotational speed of the carriage motor 26*a*.

The carriage 4 mounts thereon a thermal head 7 which is disposed in opposite relation to the platen 2, is movable toward and away from the platen 2 by a well-known head moving mechanism (not shown) operated by driving forces of a driving motor (not shown), and records images on a sheet of paper (now shown) set on the platen 2 in a state where the thermal head 7 is held in pressure contact with the platen 2 (i.e., in a head-down state). The thermal head 7 includes a plurality of heat generating elements (not shown) arrayed in a predetermined pattern and selectively energized to generate heat in accordance with desired recording information input from a suitable input unit (not shown) such as a keyboard. Also, the thermal head 7 is controlled by the controller 25 such that it can be held in pressure contact with the platen 2 selectively under one of strong contact-pressure force and weak contact-pressure force, and it can selectively generate one of two high and low levels of thermal energy applied to the thermal head 7 (specifically, it can be energized for one of two long and short periods of time during which a current is supplied to the heat generating elements).

Figure 3:
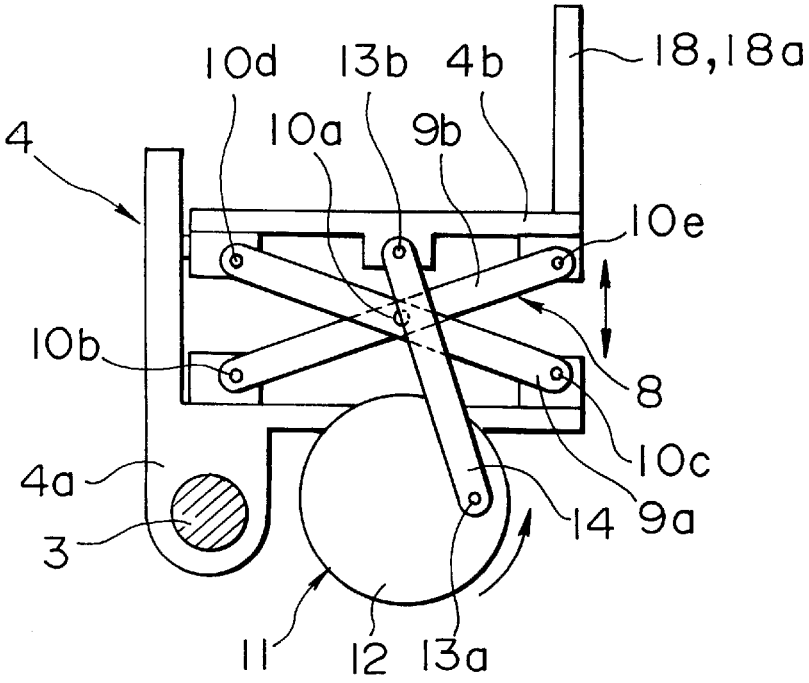
FIG. 3 is a schematic side view of a carriage of the thermal transfer printer shown in FIG. 1.

The carriage 4 will be described in more detail below. The carriage 4 is constructed of the lower carriage 4*a* which is mounted on the guide shaft 3 and the upper carriage 4*b* in the form of a plate which lies substantially parallel to the lower carriage 4*a* and is attached to an upper surface of the lower carriage 4*a* through a parallel crank mechanism 8 in such a manner as able to translate toward and away from the lower carriage 4*a*. The parallel crank mechanism 8 is provided in pair one on each of lateral opposite sides of the carriage 4 and comprises a pair of links 9*a*, 9*b* extending to cross each other in the X-form, as shown in FIG. 3. The links 9*a*, 9*b* are pivotally connected to each other by a pin 10*a* at a position where they intersect, and their ends are slidably locked by pins 10*b*, 10*c*, 10*d*, 10*e* in respective slots (not shown) formed at opposite ends of the lower carriage 4*a* and the upper carriage 4*b* on each of the lateral opposite sides thereof.

Further, a rotary crank mechanism 11 is mounted on the lower carriage 4*a* to effect translation of the upper carriage 4*b* with respect to the lower carriage 4*a*. The rotary crank mechanism 11 comprises a rotary disk 12 serving as a rotary member supported by the lower carriage 4*a* for rotation, and a joint link 14 serving as a joint member pivotally connected at its lower end to the rotary plate 12 in an eccentric position by a pin 13*a*, the joint link 14 having its upper end pivotally connected to the upper carriage 4*b* by a pin 13*b*. The rotary plate 12 is rotated by suitable driving means (not shown) such as a motor.

Returning to FIG. 1, a pair of plate-like arms 15 are vertically provided on the upper carriage 4*b* one on each of the lateral opposite sides thereof with a spacing substantially equal to the width of the ribbon cassette 5, the arms 15 curving slightly inwardly in facing relation toward their distal ends and each having bosses at its upper and lower ends. A pair of rotatable bobbins 16 are disposed in a central area of the upper carriage 4*b* such that the bobbins are spaced from each other by a certain distance and are projected upwardly from an upper surface of the upper carriage 4*b*. With rotation of the bobbins 16, the ink ribbon 17 can travel in a predetermined direction. Of the pair of bobbins 16, one serves as a reel-up bobbin 16*a* for winding the ink ribbon 17 and the other serves as a reel-out bobbin 16*b* for letting out the ink ribbon 17. At an edge of the carriage 4 on the side facing away from the platen 2, a photosensor 18*a* is disposed as a sensor 18 for detecting the type of the ink ribbon 17 housed in the ribbon cassette 5. In this embodiment, the photosensor 18*a* is of a reflection type. Then, the photosensor 18*a* is electrically connected to the controller 25 (described later) which is disposed in a desired position inside the thermal transfer printer 1 and controls the recording operation, etc of the thermal transfer printer 1.

Figure 2:
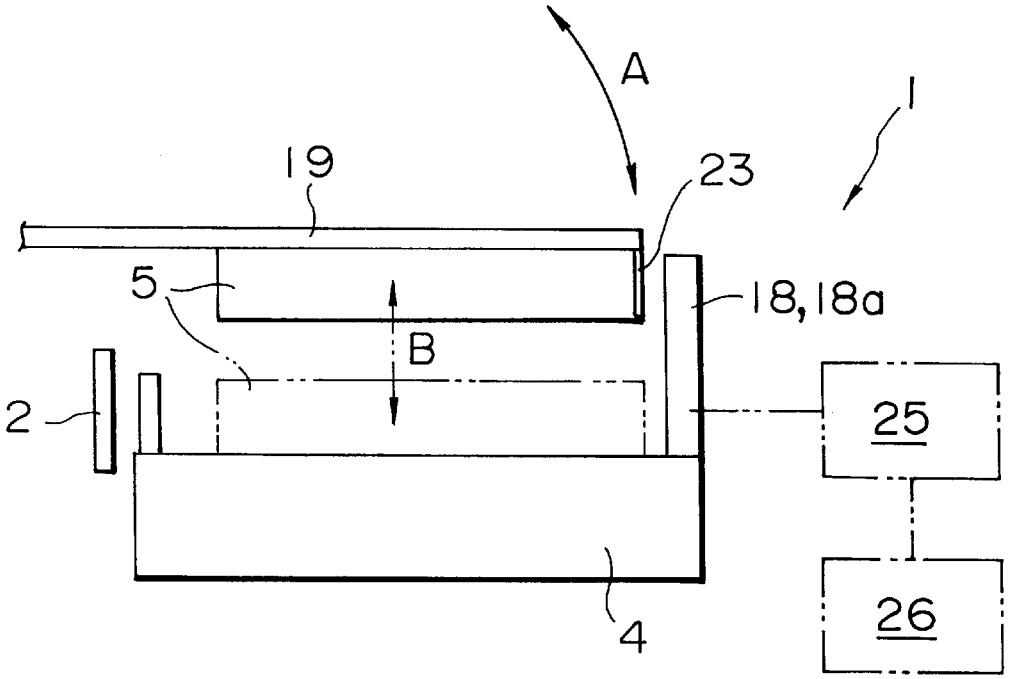
FIG. 2 is a schematic side view showing principal parts of the thermal transfer printer shown FIG. 1.

Above the carriage 4, as shown in FIGS. 1 and 2, a canopy 19 nearly in the form of a plate is disposed with an appropriate spacing therebetween and supported by the frame (not shown) to be able to freely open and close as indicated by a double-head arrow A in FIG. 2. When closed, the canopy 19 functions as a paper retainer on the outlet side of a paper feeding mechanism (not shown), is positioned in opposite relation to the carriage 4, and extends over substantially the same length as the region where the carriage 4 is movable.

A plurality of cassette holders (not shown) each holding the ribbon cassette 5 are provided on a lower surface of the canopy 19 in predetermined positions which extends parallel to the carriage 4 in opposite relation when the canopy 19 is closed. The cassette holders hold a plurality of ribbon cassettes, i.e., a ribbon cassette 5*a* housing therein an ink ribbon (heat-fusible ink ribbon) 17*a* coated with heat-fusible ink and an ribbon cassette 5*b* housing therein an ink ribbon (heat-sublimated ink ribbon) 17*b* coated with heat-sublimated ink in this embodiment, such that the cassettes are arranged to lie on a line in the moving direction of the carriage 4. The ribbon cassettes 5*a*, 5*b* are, as indicated by a double-head arrow B in FIG. 2, selectively transferred between the canopy 19 and the upper carriage 4*b* upon the operation of the parallel crank mechanism 8 which is actuated by the rotary crank mechanism 11. Note that all of the cassette holders may hold only the ribbon cassettes 5*a* housing therein the heat-fusible ink ribbons 17*a* or the ribbon cassettes 5*b* housing therein the heat-sublimated ink ribbons 17*b*.

The ribbon cassettes 5*a*, 5*b* used in this embodiment are all formed to have the same shape and the same dimensions regardless of the types of the ink ribbons 17. Each ribbon cassette has a case body 20 which is made up of a pair of vertically divided parts and is substantially rectangular in a plan view. Within the case body 20, though not shown, there are arranged a pair of rotatably supported reels, a pair of rotatably supported ribbon feed rollers, and a plurality of rotatably supported guide rollers positioned along a ribbon route. The ink ribbon 17 is wound around and extended between the pair of reels, and is exposed in its intermediate portion to the exterior. When the ribbon cassette 5 is mounted on the upper carriage 4*b*, one of the pair of reels serves a reel-up reel for winding a portion of the ink ribbon 17 which has been used for recording, and the other reel serves a reel-out reel for letting out the ink ribbon 17. The reels each have a plurality of key ways or splines formed in its inner circumferential surface with certain angular intervals therebetween in the circumferential direction. The inner circumferential surface of the reel-up reel defines a reel-up hole 21*a* in which the reel-up bobbin 16*a* is engaged, and the inner circumferential surface of the reel-out reel defines a reel-out hole 21*b* in which the reel-out bobbin 16*b* is engaged. The ribbon cassette 5 also has a recess 22 formed in its front surface facing the platen 2 when the ribbon cassette 5 is mounted on the carriage 4, such that the thermal head 7 can be positioned in the recess 22. The intermediate portion of the ink ribbon 17 is exposed to the exterior in the recess 22.

Further, an identification mark 23 for use in discriminating the type of the ink ribbon 17 housed in the ribbon cassette 5 is put on a rear surface of the ribbon cassette 5 extending parallel to the front surface thereof in which the recess 22 is formed. In this embodiment, the identification mark 23 is formed of a reflecting label 24A, 24B which has striped non-reflecting portions 24*a* different in number depending on the type of the ink ribbon 17.

Then, the identification mark 23 is detected by the photosensor 18*a* provided as cassette type detecting means on the carriage 4, and outputs a detection signal to the controller 25 of the printer. The controller 25 counts the number of the non-reflecting portions 24*a* of the identification mark 23 put on each ribbon cassette 5 and discriminates the type of the ink ribbon 17 housed in the ribbon cassette 5.

More specifically, a reflecting label 24A having four non-reflecting portions 24*a* is put as the identification mark 23 on the ribbon cassette 5*a* positioned on the left side in FIG. 1, and a reflecting label 24B having two non-reflecting portions 24*a* is put as the identification mark 23 on the ribbon cassette 5*b* positioned on the right side in FIG. 1. Then, a left end of the rear surface of the ribbon cassette 5 shown as locating on the lower side in FIG. 1 serves as a base position BP for detecting the identification mark 23, and a distance L from the base position BP to a right end edge of the non-reflecting portion 24*a* of the identification mark 23 locating at a rightmost position in FIG. 1 is set to be the same for all of the identification marks 23. The non-reflecting portions 24*a* detected for identifying the type of the ink ribbon 17 are formed in desired number within the distance L. Incidentally, the identification mark 23 makes it possible to identify not only the type of the ink ribbon 17 housed in the ribbon cassette 5, but also the color of the ink ribbon 17. When the identification mark 23 put on the ribbon cassette 5 to be used is detected by the photosensor 18*a*, the carriage 4 is stopped there. In this condition of the carriage 4 being stopped, the ribbon cassette 5 held by the cassette holder is transferred to the upper carriage 4*b*.

It is to be noted that the identification mark 23 is not particularly limited to the form of a label in the illustrated embodiment, but may be printed on the ribbon cassette 5.

On the lower carriage 4*a* of the carriage 4 capable of reciprocating along the platen 2, there are mounted a stepping motor 26 for driving the thermal head 7 to move toward and away from the platen 2, and a stepping motor 26*b* for controlling the reel-up operation of the ink ribbon (hereinafter referred to as a ribbon reel-up motor 26*b*). These stepping motors transmit power to the thermal head 7 and the reel-up bobbin 16*a* through respective transmission gears (not shown).

Figure 4:
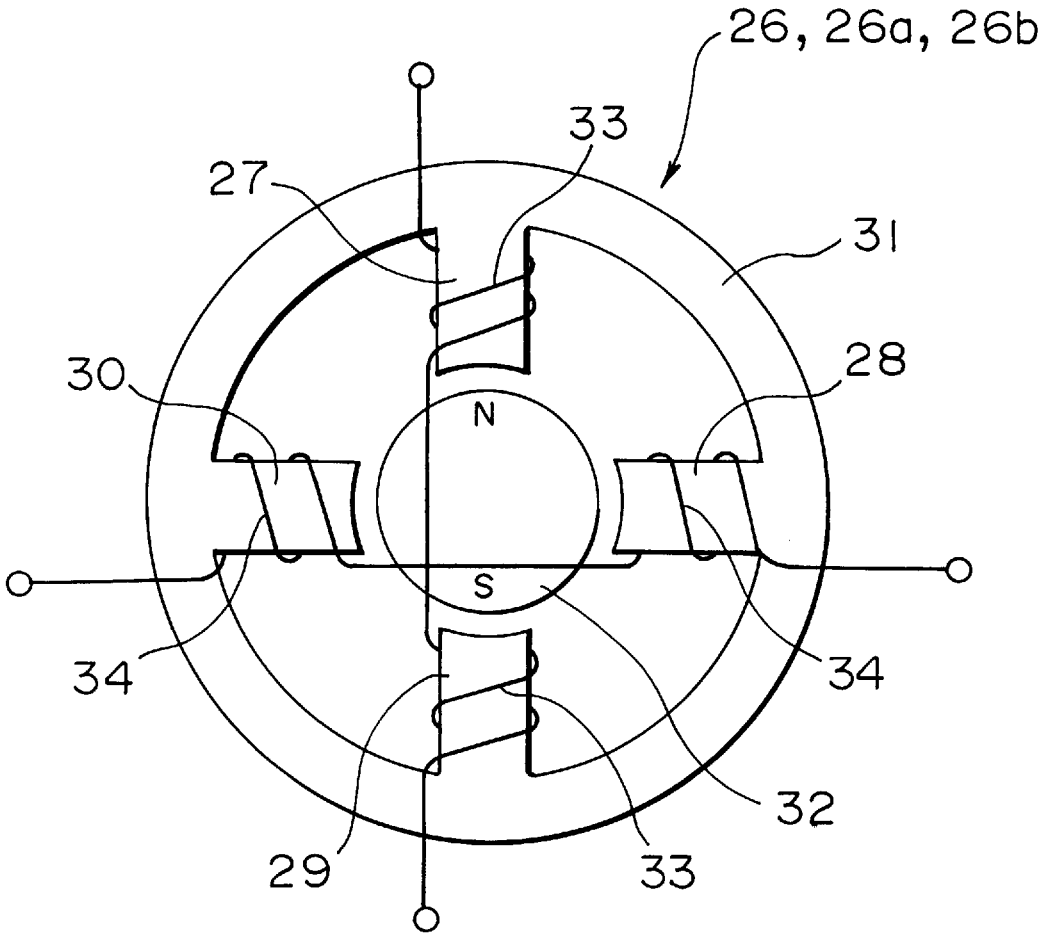
FIG. 4 is a view for explaining the principles of a carriage motor and a ribbon reel-up motor for use in the embodiment.

Each stepping motor 26 is structured as shown in FIG. 4 from the principle point of view. The stepping motor 26 comprises, by way of example, a stator 31 having first (A), second (B), third (C) and fourth (D) magnetic poles (phases) 27, 28, 29, 30 arranged with intervals of 90 degrees therebetween in the circumferential direction, and a rotor 32 made of a rotatable permanent magnet and having N and S poles arranged with intervals of 180 degrees therebetween in the circumferential direction. An output shaft (not shown) is coupled to the rotor 32. A first coil 33 is wound over the first (A) and third (C) magnetic poles 27, 29, and a second coil 34 is wound over the second (B) and fourth (D) magnetic poles 28, 30.

To rotate such a stepping motor 26, excitation currents (phase currents) are supplied to the coils 33, 34 of the stator 31 in respective phases, whereupon magnetic fields are generated to produce electromagnetic forces for attraction or repulsion between the stator 31 and the rotor 32. By switching over the excitation currents in sequence, the electromagnetic forces produced between the stator 31 and the rotor 32 are changed over to develop torque for rotating the rotor 32.

Additionally, the stepping motor 26 is energized by a bipolar driving method. The bipolar driving method is carried out by connecting a plurality of transistors (not shown) to each of the coils 33, 34 and controlling the transistors to turn on and off in proper timed relation so that a current is supplied to the coil in two directions for each phase.

Figure 5:
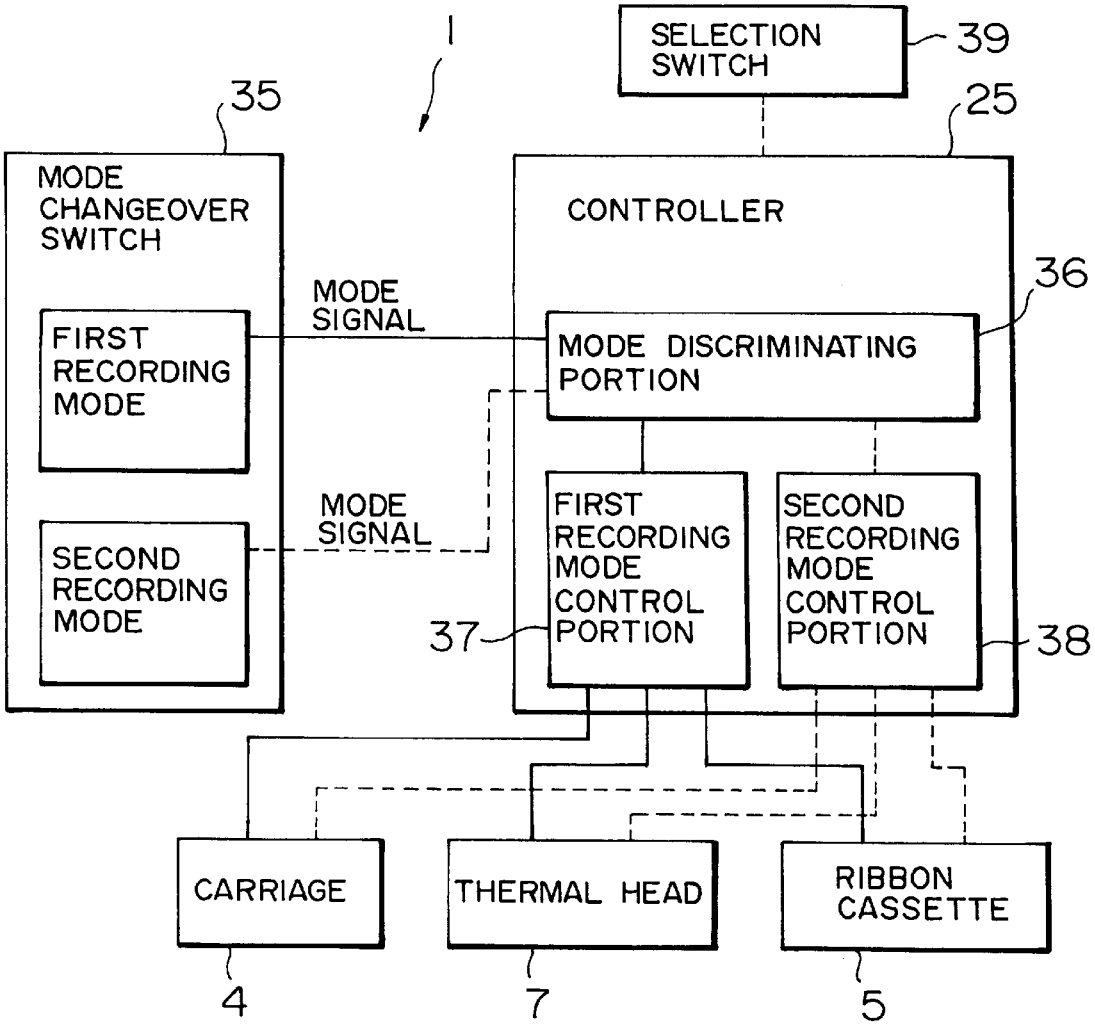
FIG. 5 is a block diagram showing the configuration of a control system of the thermal transfer printer shown in FIG. 1.

The controller 25 is constituted by a memory, a CPU and so on (not shown). As shown in FIG. 5, the controller 25 includes a mode discriminating portion 36 for discriminating at least whether a first recording mode to record images on a sheet of paper, e.g., plain paper, with thermal fusion transfer using the heat-fusible ink ribbon 17*a* or a second recording mode to record images on a sheet of specific paper with thermal sublimation transfer using the heat-sublimated ink ribbon 17*b* is to be performed, in accordance with a mode signal delivered from a mode changeover switch 35 disposed on the frame (not shown) in a desired position, and a first recording mode control portion 37 and a second recording mode control portion 38 each for controlling the rotational speeds of the carriage motor 26*a* and the ribbon reel-up motor 26*b*, the period of time during which the thermal head 7 is supplied with a current, the pressure-contact force of the thermal head 7 against the platen 2, the selection of the ribbon cassette 5, etc. to be set suitable for the recording mode in accordance with a discrimination result of the mode discriminating portion 36.

Also, in accordance with a signal output from the photosensor 18*a* upon movement of the carriage 4, the controller 25 discriminates or detects the presence or absence of the ribbon cassette 5, the type of the ink ribbon 17 housed in the ribbon cassette 5, the distance by which the carriage 4 has moved from the home position, whether the canopy 19 is opened or closed, the distance between the ribbon cassettes 5, etc.

Of the control processes executed by the first recording mode control portion 37 and the second recording mode control portion 38, the process of controlling the rotational speeds of the carriage motor 26*a* and the ribbon reel-up motor 26*b* will now be described in detail with reference to FIGS. 6 and 7.

Figure 6A:
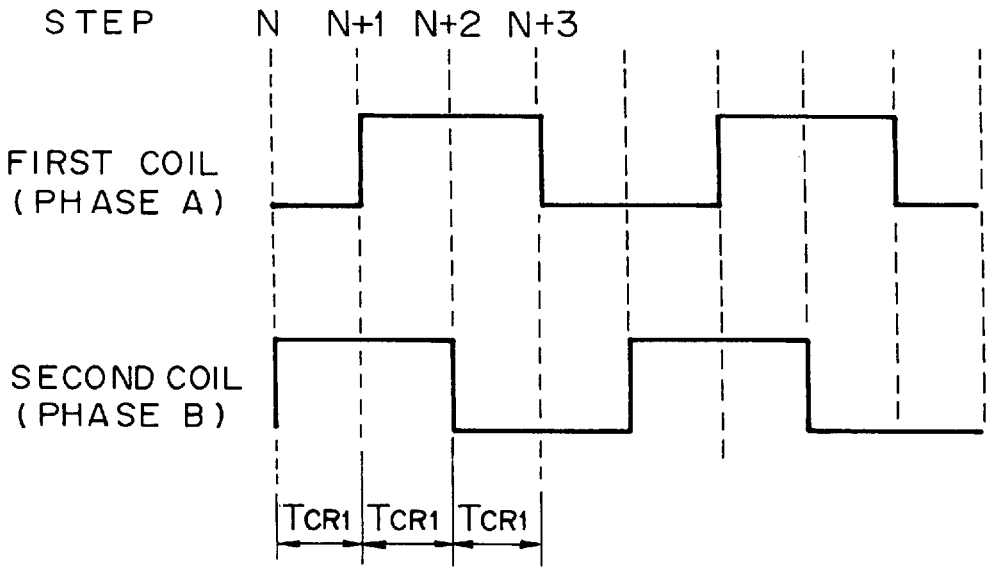
FIG. 6A is a chart for explaining the timing at which excitation currents supplied to the carriage motor are each switched over in a first recording mode in the embodiment.
Figure 6B:
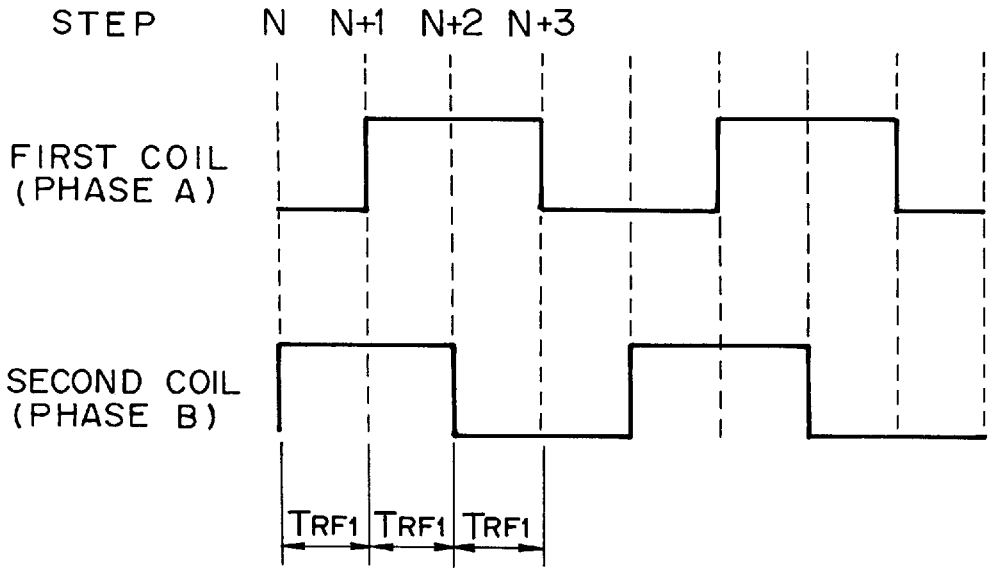
FIG. 6B is a chart for explaining the timing at which excitation currents supplied to the ribbon reel-up motor are each switched over in the first recording mode.

FIGS. 6 and 7 each show the switchover timing of the excitation currents supplied to the first coil 33 and the second coil 34 of each of the carriage motor 26*a* and the ribbon reel-up motor 26*b*. Of these drawings, FIG. 6 represents the case where the motors are controlled by the first recording mode control portion 37. Specifically, FIG. 6A shows the excitation currents supplied to the carriage motor 26*a*, and FIG. 6B shows the excitation currents supplied to the ribbon reel-up motor 26*b*.

Figure 7A:
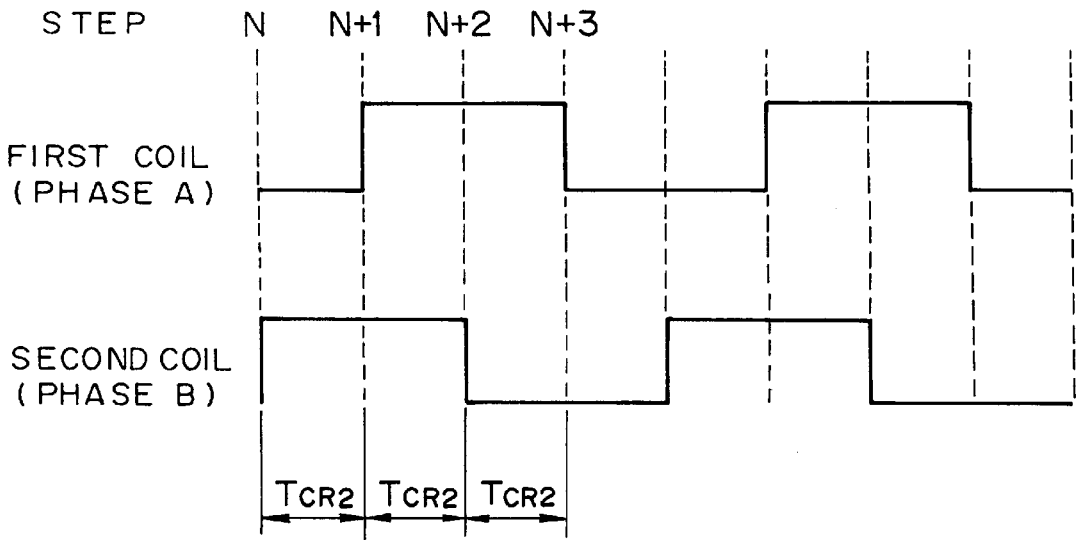
FIG. 7A is a chart for explaining the timing at which excitation currents supplied to the carriage motor are each switched over in a second recording mode in the embodiment.
Figure 7B:
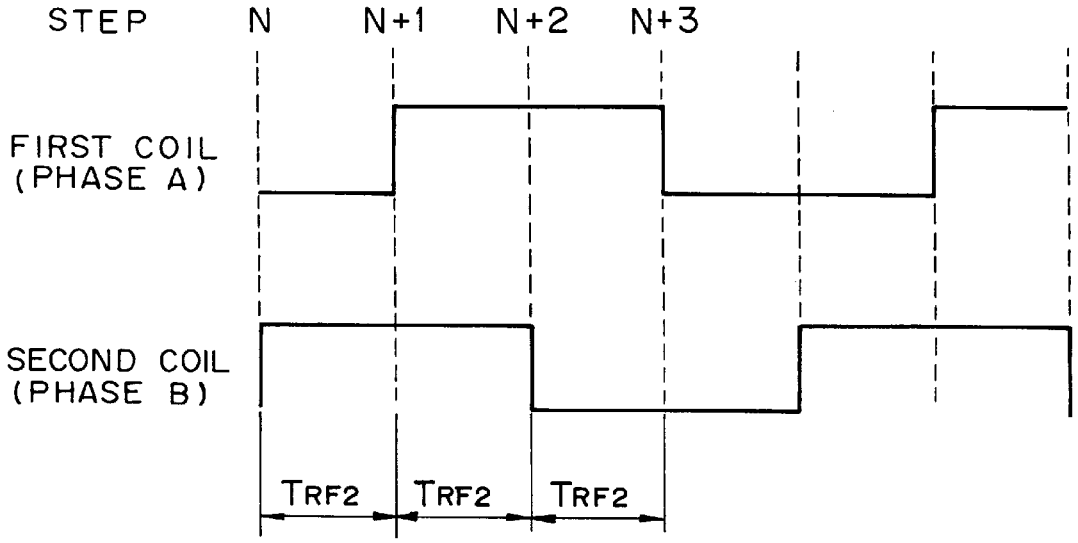
FIG. 7B is a chart for explaining the timing at which excitation currents supplied to the ribbon reel-up motor are each switched over in the second recording mode.

Also, FIG. 7 represents the case where the motors are controlled by the second recording mode control portion 38. Specifically, FIG. 7A shows the excitation currents supplied to the carriage motor 26*a*, and FIG. 7B shows the excitation currents supplied to the ribbon reel-up motor 26*b*.

As shown in FIG. 6, when the printer makes recording in the first recording mode, a ratio of a time $T_{RF1}$ during which the excitation current is supplied to the ribbon reel-up motor 26*b* and a time $T_{CR1}$ during which the excitation current is supplied to the carriage motor 26*a* is set to $T_{RF1}/T_{CR1}=1$. Further, the excitation currents supplied to the carriage motor 26*a* and the ribbon reel-up motor 26*b* are switched over at the same timing. These imply that both the motors are rotated at the same speed.

In other words, a speed ratio of a winding speed of the reel-up bobbin 16*a* and a moving speed of the carriage 4 is set to 1. To apply a tension to the ink ribbon 17, the current supply may be controlled so that the winding speed of the reel-up bobbin 16*a* is higher than the moving speed of the carriage 4 to such an extent as until about 105%.

On the other hand, as shown in FIG. 7, when the printer makes recording in the second recording mode, a time $T_{CR2}$ during which the excitation current is supplied to the carriage motor 26*a* is set to be about 3 to 5 times longer than that in the first recording mode, and the rotating speed of the carriage motor 26*a* is slowed down correspondingly.

Further, the excitation current supplied to the ribbon reel-up motor 26*b* is switched over at the timing later than that at which the excitation current supplied to the carriage motor 26*a* is switched over. In addition, the current supply time per step is set so that a time $T_{RF2}$ during which the excitation current is supplied to rotate the reel-up bobbin 16*a* is longer than the time $T_{CR2}$ during which the excitation current is supplied to move the carriage 4. A ratio of $T_{RF2}/T_{CR2}$ is set to a value in the range of 0.8–0.95. This implies that the rotational speed of the ribbon reel-up motor 26*b* is lower than that of the carriage motor 26*a* and the reel-up bobbin 16*a* starts winding the ink ribbon after the carriage 4 has moved a predetermined distance from the recording start position for each row. Here, the rotational speed of the ribbon reel-up motor 26*b* is about 80–95% of that of the carriage motor 26*a*.

The reason why the rotational speeds of the carriage motor 26*a* and the ribbon reel-up motor 26*b* should be so changed between the first recording mode and the second recording mode is as follows. In the first recording mode, since images are recorded using the heat-fusible ink ribbon 17*a*, the recording requires hot separation of ink, i.e., the heat-fusible ink ribbon 17*a* to be peeled off from a sheet of paper while the ink on the ink ribbon 17*a* is still in a molten state. In the second recording mode, however, since images are recorded using the heat-sublimated ink ribbon 17*b*, the recording requires cold separation of ink, i.e., the heat-sublimated ink ribbon 17*b* to be peeled off from a sheet of paper after the ink on the ink ribbon 17*b* has solidified.

In the above-stated control process, the rotational speeds of the carriage motor and the ribbon reel-up motor are controlled in accordance with the detection result of the photosensor 18*a* indicating whether the ink ribbon 17 in the ribbon cassette 5 is the heat-fusible ink ribbon 17*a* or the heat-sublimated ink ribbon 17*b*. But, the present invention is not limited to the above embodiment, and the motor rotational speeds may be controlled based on other suitable elements.

Examples of modifications are below. Recording medium detecting means (not shown) for detecting the type of a recording medium (paper) is provided and a detection result of the recording medium detecting means is input to the controller 25. In accordance with the detection result, the controller 25 controls the rotational speeds of the carriage motor 26*a* and the ribbon reel-up motor 26*b* in the first recording mode when the recording medium is a sheet of plain paper, and controls the rotational speeds of both the motors 26*a*, 26*b* in the second recording mode when the recording medium is a sheet of OHP paper.

As an alternative, recording speed detecting means (not shown) for detecting a recording speed of the carriage 4 is provided and a detection result of the recording speed detecting means is input to the controller 25. In accordance with the detection result, the controller 25 controls the rotational speeds of the carriage motor 26*a* and the ribbon reel-up motor 26*b*. For example, the controller 25 controls the motor rotational speeds in the first recording mode when the recording speed of the carriage 4 is higher than the predetermined recording speed, and in the second recording mode when it is lower than the predetermined recording speed.

As a further alternative, a selection switch 39 is provided as selection means for manually or automatically selecting one or more of such conditions as the type of the ribbon cassette 5, the recording mode, the recording medium and the recording speed that are to be used, and is connected to the controller 25. Alternatively, any of those conditions, including the type of the ribbon cassette, may be selected upon instruction entered from an external unit, such as a computer, to which the thermal transfer printer is connected. In particular, when the type of the ribbon cassette 5, the recording mode, the recording medium and/or the recording speed is selected from an external unit at operator's option, the operator may select a desired mode on the display screen of a CRT or the like, causing the selected result to be input to the controller 25 through an interface.

The operation of this embodiment thus constructed will be described below.

The recording mode selecting operation for selecting the recording mode and driving the thermal transfer printer 1 of this embodiment in match with the purpose of recording is performed automatically or manually upon the operator operating the mode changeover switch 35 by selecting any one of the first recording mode in which images are recorded on a sheet of paper, e.g., plain paper, with thermal fusion transfer using the heat-fusible ink ribbon 17*a*, and the second recording mode in which images are recorded on a sheet of specific paper with thermal sublimation transfer using the heat-sublimated ink ribbon 17*b*.

With the recording mode selecting operation, a mode signal corresponding to the selected one mode is delivered from the mode changeover switch 35 to the controller 25. The mode discriminating portion 36 of the controller 25 discriminates whether the mode signal delivered from the mode changeover switch 35 represents the first recording mode or the second recording mode. In accordance with the discrimination result, the controller 25 operates one of the first recording mode control portion 37 and the second recording mode control portion 38 to start the operation of selecting the ribbon cassette 5 which houses therein the ink ribbon 17 coated with heat-fusible ink or heat-sublimated ink corresponding to one of the first recording mode and the second recording mode.

Then, in response to a command issued from the controller 25 (specifically any one of the first recording mode control portion 37 and the second recording mode control portion 38), the carriage 4 in the home position is moved (traveled) therefrom and the photosensor 18*a* disposed on the carriage 4 detects the discrimination mark 23 on the ribbon cassette 5. A detection signal from the photosensor 18*a*, which is specific to the identification mark 23 depending on the array and pitch of the non-reflecting portions 24*a* thereof, is sent to the controller 25. It is determined in the controller 25 whether the identification mark 23 corresponds to the issued command. If the identification mark 23 corresponds to the issued command, the movement of the carriage 4 is stopped there. If the identification mark 23 does not correspond to the issued command, the carriage 4 continues moving until the identification mark 23 corresponding to the issued command is detected. Thus, in this embodiment, the ribbon cassette 5 (specifically the ink ribbon 17) can be surely discriminated by detecting the difference of the reflecting label 24 on the ribbon cassette 5 depending on the type of the ink ribbon 17.

With the thermal transfer printer 1 of this embodiment, since the ribbon cassettes 5 are mounted on the canopy 19 in the respective predetermined positions, the distance from the home position of the carriage 4 to the identification mark 23 on each of the ribbon cassettes 5 is fixed and the distance by which the carriage 4 has moved from the home position can be easily detected. In other words, by counting the number of steps in rotation of the carriage motor 26*a* driving the carriage 4, it is possible to easily detect the distance by which the carriage 4 has moved from the home position and hence the current position of the carriage 4. Additionally, by comparing the number of steps in rotation of the carriage motor 26*a* corresponding to the predetermined distance from the home position to the identification mark 23 on each of the ribbon cassettes 5 with the actual number of steps in rotation of the carriage motor 26*a* resulted when the carriage 4 is driven, it is also possible to detect changes in conditions of the thermal transfer printer 1 depending on temperature, such as a change in the distance between the home position and the ribbon cassette 5, a change in the distance between the ribbon cassettes 5, etc.

Further, with the thermal transfer printer 1 of this embodiment, since the ribbon cassettes 5 are mounted on the canopy 19 in the respective predetermined positions, the identification marks 23 on the ribbon cassettes 5 will be never positioned to face the photosensor 18*a* when the canopy 19 is in its open state. As a result, even with the carriage 4 is scanned in such a state, the photosensor 18*a* will never detect the identification marks 23 on the ribbon cassettes 5. This enables the controller to detect whether the canopy 19 is in the open or closed state.

Thus, with the thermal transfer printer 1 of this embodiment, since the single photosensor 18 can be used in common to detect the presence or absence and the type of the ribbon cassette 5, the current position of the carriage 4 with respect to the home position, the open or closed state of the canopy 19, etc., the printer cost can be reduced as a whole.

Subsequently, the ribbon cassette 5 housing therein the ink ribbon 17 corresponding to the selected recording mode is selectively transferred between the canopy 19 and the upper carriage 4*b*, as indicated by the double-head arrow B in FIG. 2, by the parallel crank mechanism 8 and the rotary crank mechanism 11. The operation of selecting the ribbon cassette 5 is completed with the ribbon cassette 5 mounted on the carriage 4.

After that, a sheet of paper corresponding to the selected recording mode is set between the platen 2 and the thermal head 7 manually or by a paper feeder (not shown) to start the recording operation.

In the case of the first recording mode, the first recording mode control portion 37 of the controller 25 issues a command to execute control so that the pressure-contact force of the thermal head 7 against the platen 2 in the head-down state is about 0.5–3.0 kg, the moving speed of the carriage 4 corresponding to the recording speed of the thermal head 7 is about 10–50 cm/sec, and the current supply time per dot of the heat generating elements of the thermal head 7 is 0.1 msec. This implies that, at the end of the current supply time, the temperature of the heat generating element rises to 600° C. by application of one pulse. Further, the winding speed of the reel-up bobbin 16*a* is set to the same as or about 105% of the moving speed of the carriage 4, and the heat-fusible ink ribbon 17*a* is reeled up substantially at the same time as the recording made by the thermal head 7 for achieving the hot separation of ink. As a result, images can be surely recorded on a sheet of paper, such as plain paper, with the thermal fusion transfer using the heat-fusible ink ribbon 17*a*.

Also, in the case of the second recording mode, the second recording mode control portion 38 of the controller 25 issues a command to execute control so that the pressure-contact force of the thermal head 7 against the platen 2 in the head-down state is about 0.2–1.5 kg smaller than that in the first recording mode, the moving speed of the carriage 4 mounting the thermal head 7 thereon is about 2–25 cm/sec lower than that in the first recording mode, and the current supply per dot of the heat generating elements of the thermal head 7 is performed through repeated application of the same pulse P in five divided steps over a total current supply time of 0.8 msec. This implies that, at the end of the total current supply time, the temperature of the heat generating element rises to 650° C. Further, the winding speed of the reel-up bobbin 16*a* is set lower than, i.e., to about 80–95% of, the moving speed of the carriage 4, and the heat-sublimated ink ribbon 17*b* is reeled up at the timing after the carriage 4 has moved a predetermined distance from the recording start position, for achieving the cold separation of ink. As a result, images can be surely recorded on a sheet of specific paper with the thermal sublimation transfer using the heat-sublimated ink ribbon 17*b*.

By so setting the pressure-contact force of the thermal head 7 against the platen 2 in the second recording mode smaller than that in the first recording mode, wear of the thermal head 7 is lessened in the second recording mode and hence durability of the thermal head 7 is surely improved as a whole.

Also, by operating the mode changeover switch 35 in accordance with the purpose of recording, the thermal transfer printer 1 of this embodiment can record images with simple selection of one of the first recording mode in which images are recorded on sheets of various types of paper with thermal fusion transfer using the heat-fusible ink ribbon 17*a*, and the second recording mode in which images are recorded on a sheet of specific paper with thermal sublimation transfer using the heat-sublimated ink ribbon 17*b* in high quality comparable to silver salt film photography. Therefore, general recording on usual paper and high-quality recording on specific paper comparable to silver salt film photography can be achieved by one unit of thermal transfer printer with reliability. This ensures a smaller space required for installation of the printer than conventional.

Further, when the printer performs recording in the second recording mode, the rotating speed of the ribbon reel-up motor 26*b* is set lower than that of the carriage motor 26*a* and the heat-sublimated ink ribbon 17*b* is reeled up at the timing delayed from the recording made by the thermal head 7 in contrast with the first recording mode. Therefore, the recording in the second recording mode can be stably achieved with less damages on the ink ribbon 17*b* without any complicated mechanism. This also contributes to preventing an axial shift or partial fatting of the ink ribbon 17 when it is wound, i.e., preventing it from being reeled into the form of a bamboo shoot or the like when wound over the reel.

In addition, when the ribbon cassette 5, the recording mode, the recording medium and/or the recording speed is selected through the selection switch 39 or an external input unit, the thermal transfer printer is not required in itself or thereabout to have any means for detecting those conditions. Therefore, the thermal transfer printer can reel up the ink ribbon at the optimum timing of separation of ink depending on those conditions with a simpler construction.

Note that the present invention is not limited to the embodiment stated above, but can be modified in various ways as needed.

As described hereinabove, the thermal transfer printer of the present invention can provide advantages below. Any one of recording with thermal fusion transfer and recording with thermal sublimation transfer can be selected at operator's option. Damages on the ink ribbon can be lessened and the recording can be performed in a more stable manner without requiring any complicated mechanism.

What is claimed is:

1. A thermal transfer printer comprising:

a platen;

a thermal head having a plurality of heat generating elements formed therein;

a head driving means for moving the thermal head toward and away from said platen;

a carriage mounting said thermal head and operable to reciprocate along said platen;

a carriage driving means for moving the carriage along said platen;

a carriage motor acting as a driving source for the carriage driving means;

a ribbon cassette set on said carriage and housing an ink ribbon;

a ribbon reel-up means for taking up the ribbon cassette;

a ribbon reel-up motor acting as a driving source for use in rotating said ribbon reel-up means;

cassette type detecting means for detecting the type of said ribbon cassette and generating a cassette type detection signal; and control means for receiving the cassette type detection signal from the cassette type detecting means and for selecting a recording mode for the thermal transfer printer in response to the cassette type detection signal, the recording mode being selected from a plurality of modes including a first recording mode for performing a recording with a thermal fusion transfer by a thermal fusion ink ribbon and a second recording mode for performing a recording with a thermal sublimation transfer by a heat-sublimated ink ribbon, and for controlling a rotating speed of each of said carriage motor and said ribbon reel-up motor to establish a first ratio in the first recording mode between a rotational speed of the ribbon reel up motor and a rotational speed of the carriage motor, and to establish a second ratio in the second recording mode, between the rotational speed of the ribbon reel up motor and the rotational speed of the carriage motor.

2. A thermal transfer printer according to claim 1, wherein the first ratio is greater than the second ratio.

3. A thermal transfer printer according to claim 2, wherein the cassette type detecting means is further operable to generate a first cassette type detection signal when a heat-fusible ink ribbon cassette is detected, and operable to generate a second cassette type detection signal when a heat-sublimated ink ribbon cassette is detected, and wherein the control means is further operable to select the first recording mode for the thermal transfer printer in response to the first cassette type detection signal, and operable to select the second recording mode in response to the second cassette type detection signal.

4. A thermal transfer printer comprising:

a platen;

a thermal head having a plurality of heat generating elements formed therein;

a head driving means for moving the thermal head toward and away from said platen;

a carriage mounting said thermal head and operable to reciprocate along said platen;

a carriage driving means for moving the carriage along said platen;

a carriage motor acting as a driving source for the carriage driving means;

a ribbon cassette set on said carriage and housing an ink ribbon;

a ribbon reel-up means for taking up said ribbon cassette;

a ribbon reel-up motor acting as a driving source for use in rotating said ribbon reel-up means;

a recording mode selecting means for selecting whether the mode is a first recording mode in which as recording by thermal fusion transfer is performed with a thermal fusion ink ribbon or a second recording mode in which a recording by thermal sublimation transfer is performed with a heat-sublimated ink ribbon; and a control means for controlling rotating speeds of said carriage motor and said ribbon reel-up motor to establish a first ratio in the first recording mode between a rotational speed of the ribbon reel up motor and a rotational speed of the carriage motor, and to establish a second ratio in the second recording mode, between the rotational speed of the ribbon reel up motor and the rotational speed of the carriage motor.

5. A thermal transfer printer according to claim 4, wherein the first ratio is greater than the second ratio.

* * * * *

UNITED STATES PATENT AND TRADEMARK OFFICE

CERTIFICATE OF CORRECTION

PATENT NO. : 5,860,751

DATED : January 19, 1999

INVENTOR(S) : Masashi Ogasawara

It is certified that error appears in the above-identified patent and that said Letters Patent is hereby corrected as shown below:

In the Claims

In claim 4, line 19, replace "as" with --a--.

Signed and Sealed this

First Day of June, 1999

*Attest:*

Q. TODD DICKINSON

*Attesting Officer*

*Acting Commissioner of Patents and Trademarks*